US005117878A

United States Patent [19]

Shaw et al.

[11] Patent Number: 5,117,878

[45] Date of Patent: Jun. 2, 1992

[54] DRAINFIELD FUNNEL

[76] Inventors: Mark D. Shaw, 5469 Running Creek La.; J. Tad Heyman, 11858 Olde Oaks Ct N, both of Jacksonville, Fla. 32223; Laurence M. Bierce, 2269 Villanova Cir., Jacksonville, Fla. 32218

[21] Appl. No.: 697,517

[22] Filed: Apr. 29, 1991

Related U.S. Application Data

[63] Continuation of Ser. No. 529,154, May 25, 1990, abandoned.

[51] Int. Cl.[5] ..... B65B 39/00

[52] U.S. Cl. ..... 141/333; 141/339; 141/340; 141/364; 141/365; 141/106

[58] Field of Search ..... 141/331-334, 141/339-342, 105, 106, 364, 363, 365

[56] References Cited

U.S. PATENT DOCUMENTS

| | | | |
|---|---|---|---|
| 418,738 | 1/1890 | Mowll | 141/340 X |
| 944,914 | 12/1909 | Rugg | 141/340 |
| 1,083,107 | 12/1913 | Landers | 141/340 |
| 1,521,212 | 12/1924 | Allen | 141/334 |
| 2,168,395 | 8/1939 | Damkroger | 141/340 |
| 2,174,228 | 3/1938 | Perkins | 141/339 |
| 2,315,473 | 3/1943 | Wolcott | 141/340 X |
| 2,791,148 | 5/1951 | Maisch | 141/331 |
| 4,054,184 | 10/1977 | Marcinko | 141/340 |
| 4,800,934 | 1/1989 | Boissoneault | 141/106 |
| 4,802,599 | 2/1989 | Hill | 141/331 |
| 4,832,095 | 5/1989 | Bonnell | 141/339 |
| 5,018,559 | 5/1991 | Branan | 141/339 |

FOREIGN PATENT DOCUMENTS

| | | | |
|---|---|---|---|
| 16111 | 7/1909 | United Kingdom | 141/341 |

*Primary Examiner*—Ernest G. Cusick
*Attorney, Agent, or Firm*—Thomas C. Saitta

[57] ABSTRACT

A drainfield funnel having a substantially horizontal drain surface sloping towards an opening, a substantially vertical rim around the perimeter of the drain surface and a tube extending down from the opening. The slope of the drain surface is less than 10 degrees. Preferably, the drain surface is uneven, having ridges and channels aligned with the opening. Additionally, a relatively horizontal lip extends from the top of the rim towards the interior of the device. In another embodiment, an annular shoulder connects the opening to the tube.

12 Claims, 2 Drawing Sheets

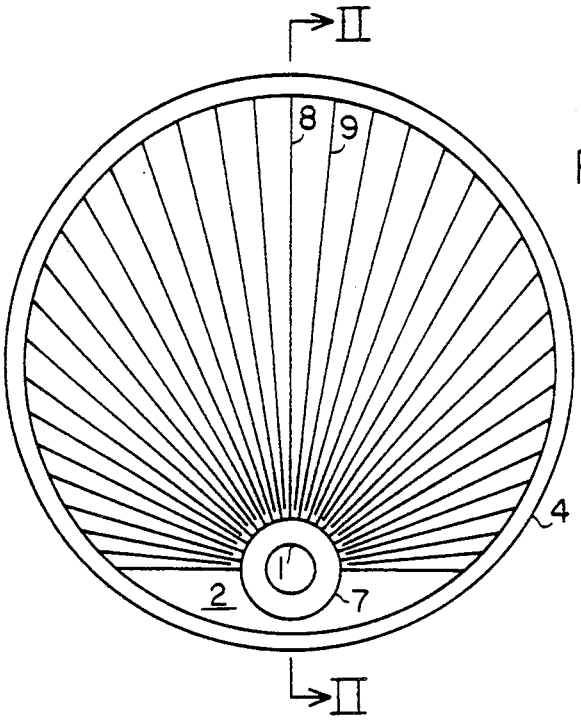
FIG. 1
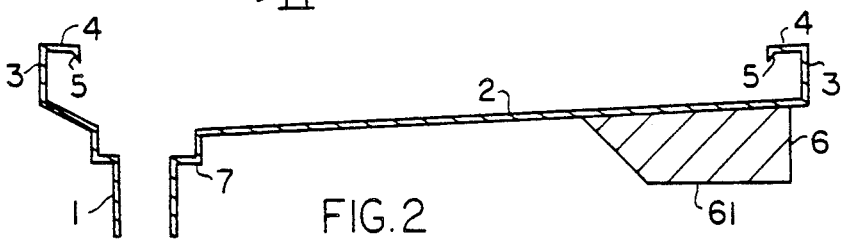
FIG. 2
FIG. 3
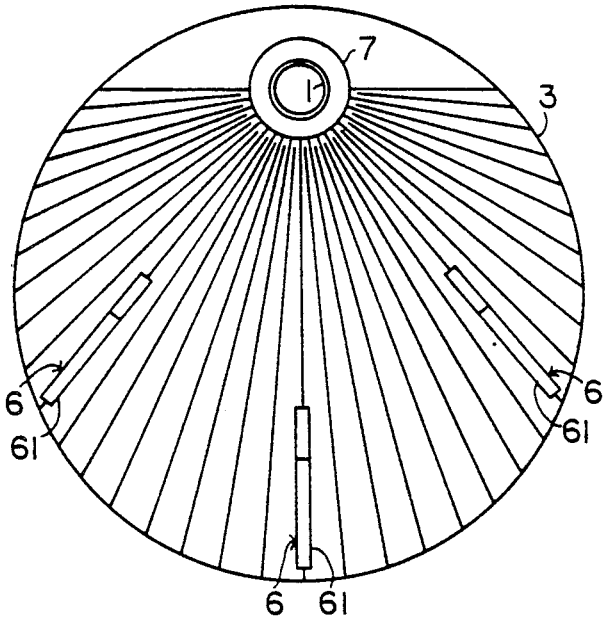

DRAINFIELD FUNNEL

This is a continuation of application Ser. No. 07/529,154 filed May 25, 1990, now abandoned.

BACKGROUND OF THE INVENTION

This invention relates generally to the field of funnel devices used to facilitate the pouring of a liquid into a small opening. More particularly, the invention relates to the field of self-supporting funnels for use on barrels or drums, the funnels having lips to prevent spillage and raised portions to support objects to be drained.

It is often desirable to pour liquids into a large container drum. The large containers are typically of a 55 gallon or 30 gallon size and have a small circular opening placed off-center in the lid. A funnel device having a large receiving end is required to prevent spillage of the liquid being poured and to insure that the liquid enters the opening in the barrel. Such devices are well known.

It is also often necessary to drain objects containing liquid - the object being inverted onto a drainfield and the liquid allowed to flow downward. For example, used automotive oil filters are inverted and placed on a drainfield so that the used oil is removed prior to disposal of the filter. In fact, a number of states have pending legislation to declare used motor oil to be a hazardous waste to be disposed of under regulated conditions, requiring that the used filters be drained for a 24 hour period. For this purpose, or for the purpose of recycling, the small amounts of used oil are collected into a large barrel for ultimate disposition.

There are currently no known funnels which are suitably structured to allow extended fluid drainage from numerous small objects into large collection drums. Most funnels are maintained upright merely by insertion of the narrow neck into the drum opening and attempting to balance it vertically, or by screwing the funnel into the opening itself where threads have been provided. No provision is made for retaining an object to be drained, nor for preventing spillage of the liquid onto the barrel lid.

The invention solves the problems outlined above by providing a novel structure which insures stability of the funnel on the top of the barrel, provides complete coverage for the barrel lid, prevents spillage over the funnel lip and provides a drainfield to receive and support numerous objects for drainage. The funnel is usable with differing size barrels and can be easily adapted to receive flame arrester mechanisms and safety bungs where required Furthermore, because the funnel has a large drain surface, liquid may be poured into the funnel at the same time that individual objects are being passively drained

BRIEF SUMMARY OF THE INVENTION

The invention is a drainfield funnel for use in conjunction with barrel or drum containers for liquids, the drums having a relatively small, off-center filler opening on one of the flat, circular ends. The invention comprises a relatively horizontal, circular drainfield having a sloping surface directed downward to an off-center nozzle adapted for insertion into the filler opening of the drum. Support legs extend below the surface of the drainfield to maintain the invention in a stable, relatively horizontal position when in place on the drum. The drainfield surface preferably has an uneven surface, as formed for example by a number of channels and ridges directed to the nozzle opening to support objects during passive drainage yet allow free flow of the liquid. A substantially vertical rim extends upward from the outside perimeter of the drainfield, and a relatively horizontal lip extends inwardly from the top of the rim to prevent spillage Preferably, the lip is slanted downward towards the center and has a bevelled portion extending downward below the inside perimeter to divert liquid surges onto the drain surface. Furthermore, the nozzle may be connected to the drainfield by an annular shoulder, allowing the invention to be adapted to receive a safety bung and flame arrester mechanism.

BRIEF DESCRIPTION OF THE DRAWINGS

FIG. 1 is a top view of the invention.

FIG. 2 is a cross-sectional view taken along line II—II of FIG. 1.

FIG. 3 is a bottom view of the invention.

DETAILED DESCRIPTION OF THE INVENTION

Figure 4:
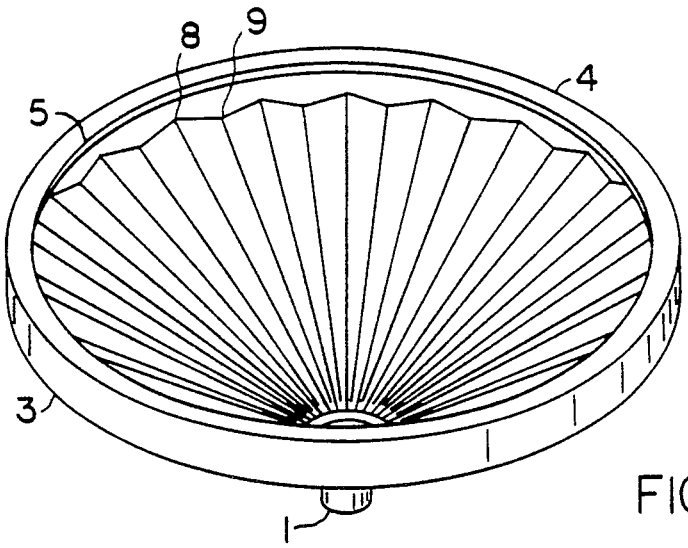
FIG. 4 is a perspective view of the invention.

The invention is a drainfield funnel adapted to be used in conjunction with large drum containers 100 having a small off-center opening 11 to receive liquids, comprising a nozzle 1 for insertion into the drum 100, a sloping drainfield surface 2, a substantially vertical rim 3, a lip 4 and legs 6, as shown with reference to the figures. The device is preferably constructed of a plastic material, such as polyethylene, but can also be constructed of metal or any other suitable material having sufficient strength and rigidity, as well as resistance to degradation by liquids.

The drainfield surface 2 is preferably circular with a diameter sufficient to match the diameter of a typical 55 gallon drum 100. For use with small drums, pails or buckets, the drainfield surface 2 and entire device may be downsized accordingly. The drainfield surface 2 is substantially horizontal, but has a small downward slope in the direction of the nozzle 1. Nozzle 1 is preferably a circular opening with a short tube extending below the drainfield surface 2. The external diameter of nozzle 1 corresponds to the internal size of the standard filler openings 11 in large drums 100, such that nozzle 1 will fit into the filler opening 11 rather snugly and extend downward into the interior of the drum 100. The nozzle 1 is positioned off-center and relatively near the outer perimeter of the drainfield surface 2. This corresponds to the standard location of the filler openings 11 in the drums 100.

The slope of the drainfield surface 2 causes liquids poured onto the surface to flow toward and into nozzle 1 without pooling on the drainfield surface 2. The drainfield surface 2 is relatively horizontal, as opposed to the significant vertical slope of most funnels, so that any objects placed onto the surface 2 for extended drainage will remain in place and not slide into and block the opening for nozzle 1. Preferably, the slope is less than 10 degrees, and even more preferably 5 degrees or less. While drainfield 2 can be a relatively smooth surface, it is preferable to facilitate drainage by incorporating an uneven surface to maintain the draining objects a distance above the flow surface, to enable the liquid to flow beneath the objects being passively drained without interference. As shown in the FIG. 4, this can be accomplished by the use of a series of ridges 8 and channels 9 radiating from the center of nozzle 1 to form a scalloped or sea shell pattern in the drainfield surface 2. Objects to be drained are set onto the drainfield surface 2. Ridges 8 maintain the object in an elevated position, allowing the liquid to easily flow from the object and down channels 9 into nozzle 1. Other patterns can be substituted for the scalloped pattern to accomplish the same purpose of elevating the object and directing flow into the nozzle 1.

A substantially vertical rim 3 extends upward from the outer perimeter of drainfield surface 2. Rim 3 acts to prevent sudden overflow of any large liquid amounts quickly dumped onto the drain surface 2, retaining the liquid until it can all be drained through nozzle 1 into the drum 100. Preferably, a lip 4 extends inwardly from the top of rim 3 to prevent spillage if a large amount of liquid is rapidly poured into the side of the device. Lip 4 is relatively horizontal, with preferably a small downward slope towards the center of the drainfield surface 2 in case any liquid is dripped onto the top of the lip 4. Lip 4, in conjunction with rim 3, acts to direct any large liquid surge back into the center of the drainfield surface 2 rather than allowing it to splash up and out of the device. Preferably, the inner perimeter of lip 4 has a bevelled flange 5 extending down towards the drainfield surface 2. This bevelled flange 5 is angled at approximately 45 degrees, and further directs any liquid surge down towards the drainfield surface 2 to prevent splashing.

Figure 5:
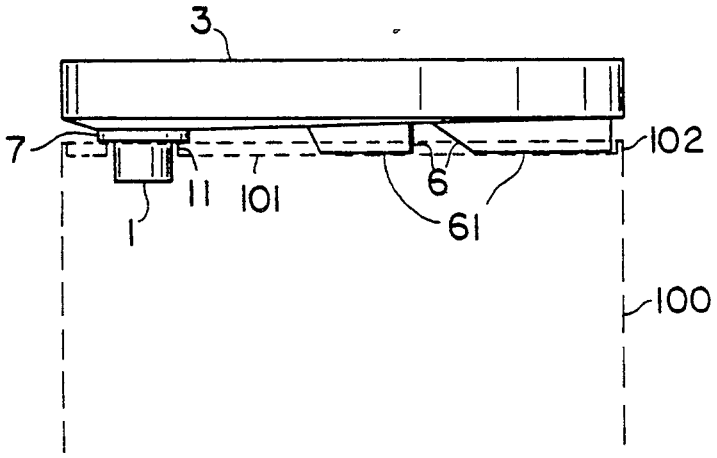
FIG. 5 is a side view showing the invention situated on a large drum.
Figure 6:
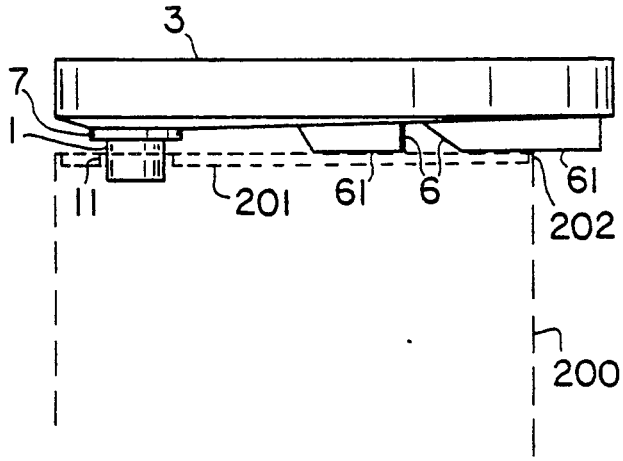
FIG. 6 is a side view showing the invention situated on a smaller drum.

The device must be stable and relatively horizontal when placed onto the drum 100, so legs 6 extend below the drainfield surface 2. The bottoms 61 of legs 6 lie in the same plane so that the device can be rested on the drum lid 101 in a substantially horizontal position. Preferably, legs 6 are positioned so that they will fit just inside the vertical rim 102 and directly on the surface of the lid 101, to prevent the device from sliding or spinning, as shown in FIG. 5. The legs 6 are also preferably constructed to have a flat bottom surface 61 extending a distance of several inches. This allows the device to be used with smaller drums, such as the 30 gallon size, which have a correspondingly smaller overall diameter, as shown in FIG. 6. The device is placed directly onto the 30 gallon drum 200 such that the flat bottom surface 61 of the legs 6 sit atop the vertical rim 202 of the drum lid 201. The insertion of the nozzle 1 into the drum opening 11 will prevent the device from sliding off drum 200. If desired, the device could also be constructed so as to have a relatively planar surface on the bottom of the drainfield surface 2 in place of the legs 6, whereby the planar surface would rest on the drum lid 101 or drum lid rim 202.

Nozzle 1 can extend directly from drainfield surface 2, but preferably the two are separated by an annular shoulder 7. Annular shoulder 7 is circular with a larger diameter than nozzle 1, having a horizontal surface situated below the surface of drainfield surface 2 surrounded by a substantially vertical wall. This construction allows the device to be used with such devices as safety bungs or flame arresters, devices well known in the art, by providing a horizontal surface to receive the fitting mechanisms and gaskets of these devices. In this use, the tube portion of nozzle 1 would be removed, the safety bung itself acting to maintain the device in position on the drum 100. By lowering annular shoulder 7 below the drainfield surface 2, the fittings will not interfere to any great degree with the flow of liquid into the drum.

It is to be understood that the examples set forth above are by way of illustration only and that the true scope and definition of the invention is as set forth in the following claims.

We claim:

1. A funnel, adapted for use in combination with a 55 gallon or smaller drum having a horizontal drum lid, a drum receiving opening in said drum lid and a vertically extending drum outer rim around said drum lid, said funnel comprising:

a sloping drain surface having an outer perimeter and an opening located within the interior of said perimeter, said drain surface sloping downward from said perimeter to said opening at an angle of ten degrees or less, whereby objects placed on said drain surface will remain in place without sliding, said drain surface comprising a series of ridges and channels radiating from said opening whereby said ridges support said objects being drained in an elevated position and said channels allow free flow of liquid beneath said objects;

a substantially vertical rim extending upward from said perimeter of said drain surface;

a tube extending downward from said opening;

legs for supporting said drain surface on said drum whereby said tube extends into said drum receiving opening, each said leg comprising a depending flange extending longitudinally in a radial direction from said opening having an extended flat bottom surface adapted to rest directly on said drum horizontal lid within said drum outer rim where said drum is a 55 gallon drum, and where said flat bottom surface of each said leg rests directly on said drum outer rim without contacting said drum horizontal lid where said drum is smaller than a 55 gallon drum.

2. The device of claim 1, where said drain surface slopes five degrees or less.

3. The device of claim 1, wherein said perimeter is circular.

4. The device of claim 1, where said opening of said funnel is off-center.

5. The device of claim 1, where said drain surface is uneven.

6. The device of claim 1, further comprising a lip extending inwardly from the top of said rim.

7. The device of claim 6, where said lip has an upper surface slanting downward toward the interior of said perimeter.

8. The device of claim 6, where said lip has a flange extending downward along the interior of said lip.

9. The device of claim 8, where said flange has a bevelled shoulder of 45 degrees.

10. The device of claim 1, where said tube is connected to said opening by an annular shoulder having a horizontal surface and a substantially vertical annular wall.

11. The device of claim 1, where said device is made of plastic.

12. The combination of a funnel and a 55 gallon or smaller drum having a horizontal drum lid, a drum receiving opening in said drum lid and a vertically extending drum outer rim around said drum lid, comprising:

a sloping drain surface having an outer perimeter and an opening located within the interior of said perimeter, said drain surface sloping downward from said perimeter to said opening at an angle of ten degrees or less, whereby objects placed on said drain surface will remain in place without sliding, said drain surface comprising a series of ridges and channels radiating from said opening whereby said ridges support said objects being drained in an elevated position and said channels allow free flow of liquid beneath said objects;

a substantially vertical rim extending upward from said perimeter of said drain surface;

a tube extending downward from said opening;

legs for supporting said drain surface on said drum whereby said tube extends into said drum receiving opening, each said leg comprising a depending flange extending longitudinally in a radial direction from said opening having an extended flat bottom surface adapted to rest directly on said drum horizontal lid within said drum outer rim where said drum is a 55 gallon drum, and where said flat bottom surface of each said leg rests directly on said drum outer rim without contacting said drum horizontal lid where said drum is smaller than a 55 gallon drum.

* * * * *